United States Patent [19]

Yamaguchi et al.

[11] Patent Number: 4,604,774

[45] Date of Patent: Aug. 12, 1986

[54] SLIDING CLASP FASTENER

[75] Inventors: Yoshiharu Yamaguchi, Namerikawa; Masashi Doi, Kurobe, both of Japan

[73] Assignee: Yoshida Kogyo K. K., Tokyo, Japan

[21] Appl. No.: 704,175

[22] Filed: Feb. 22, 1985

[30] Foreign Application Priority Data

Feb. 24, 1984 [JP] Japan ..... 59-33764

[51] Int. Cl.[4] ..... A44B 19/40

[52] U.S. Cl. ..... 24/389; 24/391; 24/392; 24/396; 428/173

[58] Field of Search ..... 24/391, 392, 396, 399, 24/397, 389, 426; 428/173

[56] References Cited

U.S. PATENT DOCUMENTS

| | | | |
|---|---|---|---|
| 2,095,270 | 10/1937 | Silberman | 24/426 |
| 2,184,625 | 12/1939 | Sipe | 24/389 |
| 3,449,803 | 6/1969 | Manning | 24/396 |
| 3,574,658 | 4/1971 | Fulk et al. | 428/173 |
| 3,607,519 | 9/1971 | Beyer | 428/173 |
| 3,711,903 | 1/1973 | Brown | 24/389 |
| 4,081,188 | 3/1978 | Westcott | 428/173 |
| 4,247,968 | 2/1981 | Moertel | 24/392 |
| 4,370,194 | 1/1983 | Shaver et al. | 428/173 |

*Primary Examiner*—Victor N. Sakran

*Attorney, Agent, or Firm*—Hill, Van Santen, Steadman & Simpson

[57] ABSTRACT

A sliding clasp fastener comprising a pair of support tapes carrying rows of coupling elements thereon and a slider adapted to couple and uncouple the rows of elements. The elements are formed from a plastic monofilament into a continuous spiral or meander formation. The monofilament is provided with a multiplicity of indents arranged to extend longitudinally thereof, the indents being filled with a lubricative agent.

5 Claims, 10 Drawing Figures

SLIDING CLASP FASTENER

BACKGROUND OF THE INVENTION

1. Field of the Invention

This invention relates to a sliding clasp fastener and more particularly to improvements in coupling elements used therein.

2. Prior Art

Sliding clasp fasteners or zippers find extensive application on garments, shoes, bags and other daily commodities as well as on industrial materials and products.

It has been a common practice to apply certain lubricating materials such as paraffin to the coupling elements of the fastener as and when the same fails to function smoothly in use. This was done by coating or otherwise depositing such lubricating material on the exposed outer surface of the fastener elements. The lubricating material thus applied was susceptible to separation from the elements under the influence of external physical forces exerted when cleaning, or by the chemical action of cleaning solvents in cleansers, or by repeated impinging contact of the coupling heads of mating elements during opening and closing of the fastener. As a result, the fastener would malfunction or even become inoperative.

SUMMARY OF THE INVENTION

With a view to overcoming the foregoing drawbacks of the prior art, the present invention is aimed at the provision of a sliding clasp fastener having a continuous row of plastic monofilamentary coupling elements which can retain the proper and smooth functioning over extended periods of use or even after it has undergone repeated cleaning.

According to the invention, there is a sliding clasp fastener comprising a pair of opposed support tapes, rows of coupling elements having a continuous spiral or meander formation provided with coupling heads and made from a plastic monofilament, and a slider member adapted to take said rows of elements into and out of sliding engagement with each other, said monofilament having a multiplicity of indents extending longitudinally thereof, and a lubricative agent filled in said indents. The indents may be of various forms but are in all cases oriented to extend longitudinally of a starting monofilament.

The invention will be better understood from the following descripting taken in conjunction with the accompanying drawings.

DETAILED DESCRIPTION

Figure 5:
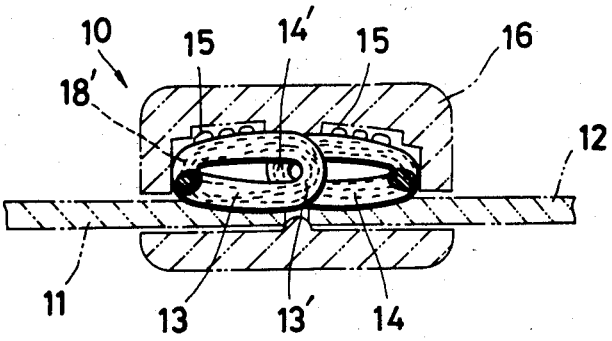
FIG. 5 is a cross-sectional view of the mating fastener elements coupled together in the slider member.

FIG. 5 shows a typical form of a sliding clasp fastener 10 which comprises a pair of opposed fastener support tapes 11, 12 carrying rows of coupling elements 13, 14 attached to the respective tapes as by stitchings 15 and taken into and out of mutual engagement by a slider member 16.

Figure 3:
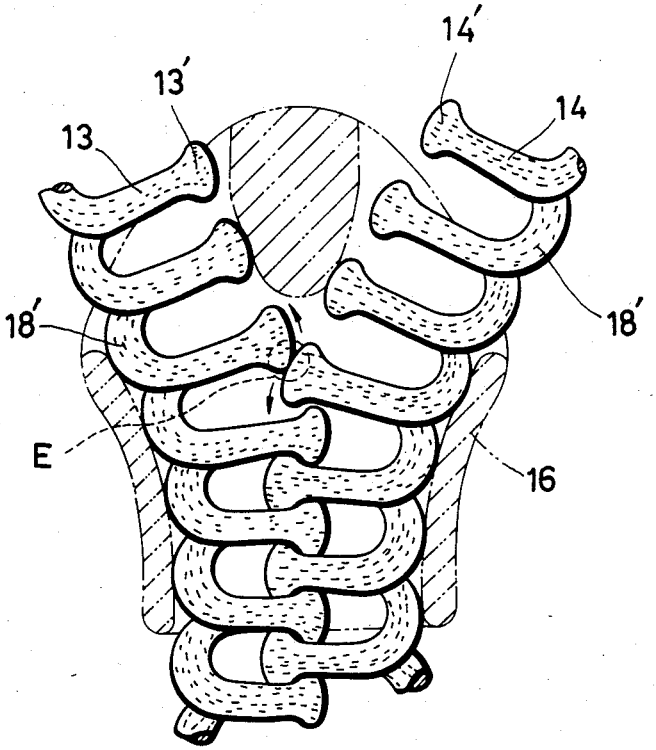
FIG. 3 is a plan view of mating rows of fastener elements coupled together by and in a slider member.

The coupling elements 13, 14 to which the present invention is directed are formed from a plastic filamentary material such as polyamide and polyester resins into a continuous spiral or meander formation, the illustrated embodiment being in spiral form as better shown in FIG. 3.

Figures 1A, 1B, 1C:
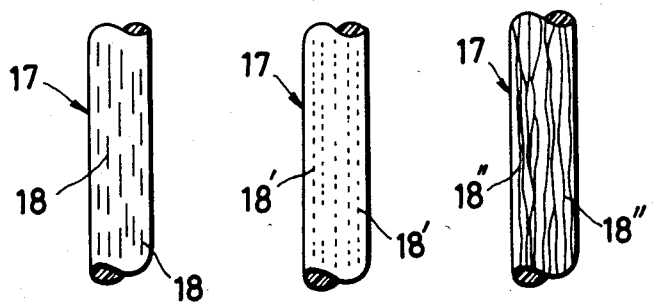
FIGS. 1A, 1B and 1C are fragmentary views each schematically illustrating the form of filamentary fastener elements provided in accordance with the invention.
Figure 2A:
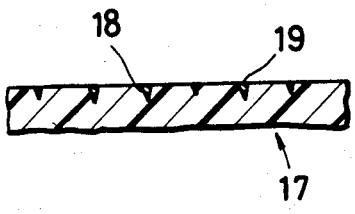
FIGS. 2A through 2D are cross-sctional views on enlarged scale each schematically illustrating the formation of indents filled with lubricative material in the surface of the fastener element.
Figure 2B:
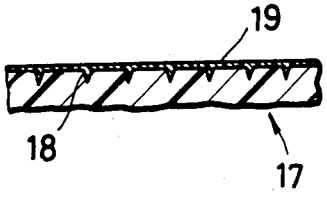
Figure 2C:
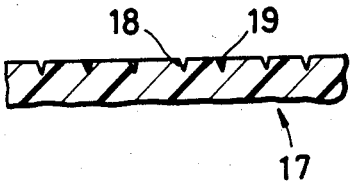
Figure 2D:
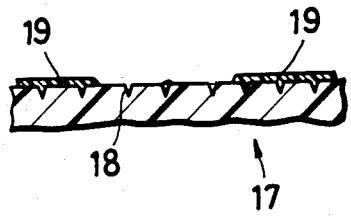

The plastic filament designated at 17 in FIG. 1 is provided in its peripheral surface with a multiplicity of minute indents 18, the term "indent" comprehensively representing a concave contour such as a groove or a recess, which indents are filled with a suitable lubricative material as hereafter described. The indents 18 shown in FIG. 1A are in the form of discrete lines of varied lengths; the indents 18' in FIG. 1B are in the form of dots, and the indents 18" in FIG. 1C are in the form of continuous lines. Importantly, the indents 18, 18' and 18" regardless of their different configurations are oriented and distributed longitudinally or in the direction of the length of the filament 17 for purposes hereafter described.

The indents 18, 18' and 18" are invisibly small, their widths and depths being of the order of 0.1 to 10s microns which may be determined such that elasticity and other functional requirements of the sliding clasp fastener are retained.

The indents 18, 18' and 18" may be formed by extruding a starting filament from a nozzle provided in its internal periphery with ridges and grooves designed to impart the particular indents to the peripheral surface of the filament 17. The indents may be also formed by passing the filament 17 in contact with a coarse surface having fine particles theron, or by blasting a stream of air mixed with particulate material over and longitudinally of the filament 17. Alternatively, the indents 18, 18' and 18" may be formed when spinning a starting filament with due consideration as regards draw ratio, temperature and other conditions as may be envisaged by one skilled in the art.

The lubricative agent to be used in the invention and designated at 19 in FIG. 2 may be any material which is resistant or immune to chemical attack by cleansers or their solvents used in cleaning the fastener. Such eligible materials are polyethylene, polysiloxane, polytetrafluoroethylene, polypropylene and the like.

The lubricative agent 19 may be dissolved or dispersed in a suitable solvent which can be applied uniformaly over the filament 17, and is well penetrative and volatile to permit quick drying. In the case of a low molecular weight polyethylene lubricative agent 19, substantially homogeneous fine particles of this material are dissolved or dispersed in the solvent, applied to the peripheral surface of the filament 17, dried to strip off the solvent and heated at a temperature above the melt point of ethylene to allow firm embedment of the lubricative agent 19 in the indents 18, (18', 18"). This process can be shortened by treating the filament 17 directly with liquefied polyethylene.

The application of the lubricative agent 19 to the filament 17, that is to fill and embed the agent 19 in the indents 18, (18', 18") in the filament 17, as schematically illustrated in FIGS. 2A–2D, is accomplished by means of roll coating, spraying or immersing in a solution or dispersion of lubricative agent 19. This can be done during extrusion of the filament 17, after the filament 17 has been formed into coupling elements 13, 14, or after a complete product fastener has been made, whichever is more convenient.

The type of lubricative agent 19 to be used depends upon the type of filament 17 which is most commonly polyamide and polyester resins. In the case of polyamide filament, the most suitable lubricative agent is polyethylene because it is less water-absorptive and can therefore minimize water-absorption of the filament per se so as to retain the properties and dimensional stability of the coupling elements 13, 14.

Figure 4:
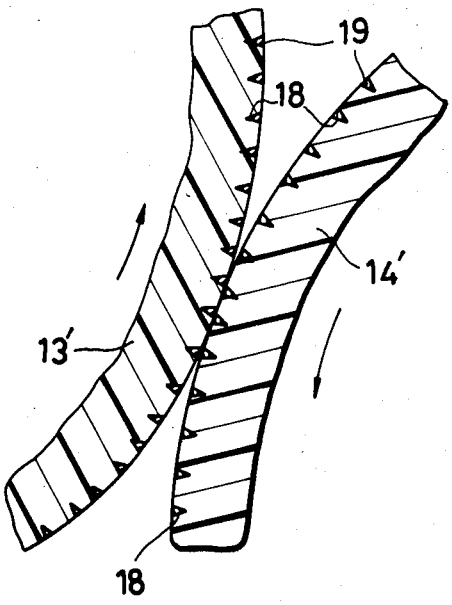
FIG. 4 is a schematic view on enlarged scale illustrating the encircled portion E of the fastener element shown in FIG. 3.

FIG. 3 shown on enlarged scale a fragmentary portion of the fastener 10 in which opposed rows of coupling elements 13, 14 are received in the slider member 16. The coupling heads 13' and 14' of the mating elements 13 and 14 are brought into and out of sliding engagement with one another in the direction of the arrows. Since the coupling heads 13', 14' are formed at the portions of the elements 13, 14 which are turned into adjacent convolutions as better shown in FIG. 5, the indents 18 in the elements 13, (14) at the region of their coupling heads 13'(14') are oriented to extend perpendicularly with respect to the plane of the fastener 10 or the plane of FIG. 4 showing the encircled portion E of FIG. 3 on more enlarged scale, or transversely of the width of the fastener 10. Movement of the slider member 16 in one direction or the other causes the coupling heads 13', 14' to come into sliding contact with each other, the contact taking place in a direction parallel to the plane of FIG. 4 with the result that the forces of sliding contact are directed to urge the lubricative agent 19 rather into than out of the indents 18. This ensures prolonged retention of the lubricative agent 19 on the coupling elements 13, 14 which leads to maintenance of lubricity and smooth coupling and uncoupling operation of the fastener 10. The indents 18, 18' and 18'' are all so minute that elasticity desired of the filament 17 can be also retained.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A sliding clasp fastener, comprising: a pair of opposed support tapes, rows of coupling elements having a continuous spiral or meander formation provided with coupling heads and made from a plastic monofilament, and a slider member adapted to take said rows of elements into and out of sliding engagement with each other, said monofilament having a multiplicity of indents extending longitudinally thereof, said indents at the coupling heads of the elements being oriented to extend perpendicularly with respect to the plane of the fastener, and a lubricative agent filled in at least some of said indents.

2. A sliding clasp fastener as claimed in claim 1 wherein said indents are in the form of discrete lines of varied lengths oriented in the direction of the length of the monofilament.

3. A sliding clasp fastener as claimed in claim 1 wherein said indents are in the form of dots oriented and distributed in the direction of the length of the monofilament.

4. A sliding clasp fastener as claimed in claim 1 wherein said indents are in the form of continuous lines extending longitudinally of the monofilament.

5. A sliding clasp fastener as claimed in claim 1 wherein said lubricative agent is a material resistant to cleaning solvents or cleansers and selected from the group of polyethylene, polysiloxane, polytetrafluoroethylene and polypropylene.

* * * * *